US007624582B2

(12) United States Patent
Hellesmark et al.

(10) Patent No.: US 7,624,582 B2
(45) Date of Patent: Dec. 1, 2009

(54) CARGO EVAPORATION DEVICE FOR USE WHEN UNLOADING SHIPS

(75) Inventors: Svein Borge Hellesmark, Fevik (NO); Claes W. Olsen, His (NO)

(73) Assignees: Remora Technology AS, Stavanger (NO); Torp Technology AS, Stavanger (NO)

( * ) Notice: Subject to any disclaimer, the term of this patent is extended or adjusted under 35 U.S.C. 154(b) by 451 days.

(21) Appl. No.: 10/554,821

(22) PCT Filed: Apr. 29, 2004

(86) PCT No.: PCT/NO2004/000120

§ 371 (c)(1),
(2), (4) Date: Jun. 20, 2006

(87) PCT Pub. No.: WO2004/097285

PCT Pub. Date: Nov. 11, 2004

(65) Prior Publication Data

US 2007/0214803 A1 Sep. 20, 2007

(30) Foreign Application Priority Data

Apr. 30, 2003 (NO) ..... 20031962

(51) Int. Cl.
*F17C 9/02* (2006.01)
*B63B 35/44* (2006.01)

(52) U.S. Cl. ..... 62/50.2; 114/264

(58) Field of Classification Search ..... 62/5.2; 114/264

See application file for complete search history.

(56) References Cited

U.S. PATENT DOCUMENTS

| | | | | |
|---|---|---|---|---|
| 2,940,268 | A * | 6/1960 | Morrison | 62/7 |
| 6,298,671 | B1 | 10/2001 | Kennelley et al. | |
| 6,546,739 | B2 * | 4/2003 | Frimm et al. | 62/50.2 |
| 7,308,863 | B2 * | 12/2007 | de Baan | 114/264 |
| 2002/0095284 | A1 | 7/2002 | Gao | |

FOREIGN PATENT DOCUMENTS

| | | |
|---|---|---|
| NO | 316791 | 1/2001 |

* cited by examiner

*Primary Examiner*—William C Doerrler
(74) *Attorney, Agent, or Firm*—Richard C. Woodbridge; Fox Rothschild LLP

(57) ABSTRACT

A coupling unit device for unloading of a ship, where the coupling unit comprises a hull and is arranged to be connected to the ship by means of a connecting element wherein the coupling unit is provided with an evaporator for liquefied natural gas (LNG) and the required pipe elements for transporting liquefied natural gas from the ship to the evaporator, as well as the required pipe elements for transporting the evaporated gas from the evaporator to a pipe for onward transport. The coupling unit is free-floating and is arranged to maneuver itself to the ship during the connection and disconnection from the ship by means of its own propulsion machinery.

7 Claims, 4 Drawing Sheets

CARGO EVAPORATION DEVICE FOR USE WHEN UNLOADING SHIPS

CROSS REFERENCE TO RELATED APPLICATIONS

The present application is related to, and claims priority from, PCT/NO2004/000120 filed Apr. 29, 2004, and Norway Patent Application No. 20031962 filed on Apr. 30, 2003, the entire contents of which are hereby incorporated by reference in their entirety.

BACKGROUND OF THE INVENTION

1. Field of the Invention

This invention regards a cargo evaporation device for use when unloading ships. More particularly, it concerns a floating coupling unit arranged to connect to a ship, preferably at the ship's loading manifold, and which is provided with a submerged cargo evaporation device. The coupling unit is connected to a gas receiving installation via a pipeline.

2. Description of Related Art

It is well known that liquefied natural gas (LNG) is transported in a chilled state across great distances in purpose-built ships. At the receiving site, the liquefied gas is normally pumped from the ship and into storage tanks of a considerable size, whereupon the gas is evaporated prior to flowing into a distribution network.

Evaporation of natural gas from the highly chilled, liquid form into a gaseous form requires a significant addition of heat to the gas.

Thus, receiving installations for liquefied natural gas are relatively large, as the same time as the costs of building and operating such installations are significant.

In areas where no such receiving installations are provided, the gas cargo on the ship can not be unloaded immediately but at the rate of consumption of the gas.

It is known to use the carrier as a storage facility for the gas while it is being pumped into the gas receiving installation. Thus U.S. Pat. No. 6,089,022 concerns a ship for transport of liquefied natural gas, provided with gas evaporators. The evaporators are heated by seawater. The ship is designed to deliver evaporated natural gas to an onshore installation as the gas is used.

Consequently, in the case of installations according to prior art, each ship must be provided with a gas evaporation plant.

The object of the invention is to remedy the disadvantages of the prior art.

SUMMARY OF THE INVENTION

The object is achieved in accordance with the invention, by the characteristics given in the description below and in the following claims.

A floating, preferably free-sailing coupling unit is connected to a receiving installation for gas via a pipe or hose connection. The coupling unit is provided with a propulsion machinery and is arranged to connect to a ship, preferably at the ship's loading manifold, in a manner that is known per se, e.g. by the use of hawsers, buoyancy, suction cups, magnets or similar.

The propulsion machinery of the coupling unit may be provided with sufficient pushing power to maintain a ship which is connected to an anchorage point, in the correct position. Use of the ship's bow thrusters in addition to the coupling unit's propulsion machinery may be sufficient for the required positioning.

The coupling unit is arranged to connect to the ship's normal loading manifold and receive liquefied natural gas.

From the ship's ordinary loading manifold, the liquefied gas flows, preferably via gas pumps, to a submerged evaporator located on the coupling unit. After the gas has evaporated, it flows to the consuming point or an onshore gas distribution network via the pipeline.

The energy for evaporation of gas comes from seawater that is pumped through the evaporator.

If the temperature of the seawater at the unloading site is too low to be able to deliver the required energy to the evaporation process, energy may be supplied from the ship's steam boiler or another source of energy located on the ship, on the coupling unit or onshore.

The coupling unit is well suited for remote control and may with advantage be used unmanned.

As appears from the description above, the coupling unit may be used when loading ordinary ships by use of the ship's normal loading manifold, without requiring any conversions on the ship.

These and other features of the invention will be more fully understood by reference to the following drawings.

Figure 1:
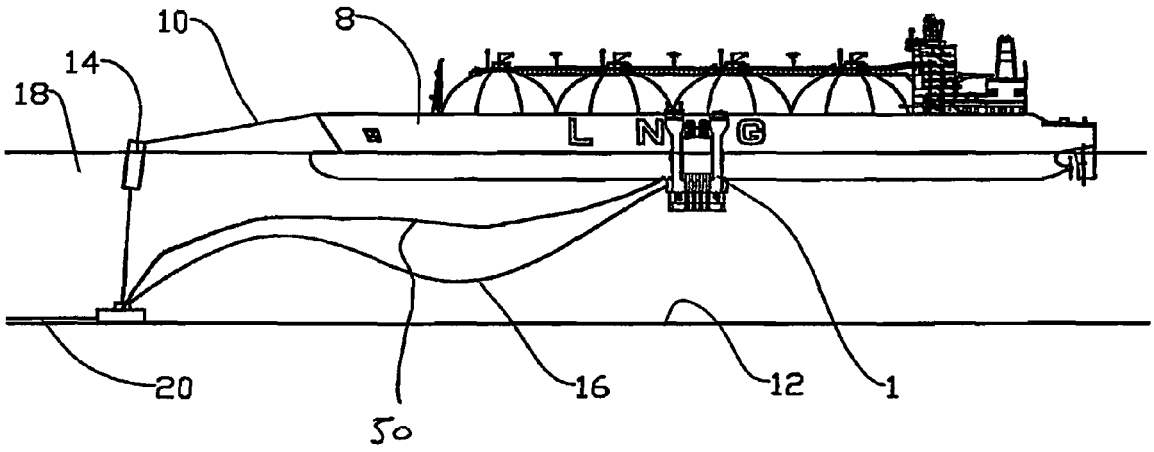
FIG. 1 shows a coupling unit connected to a ship, the ship being moored to a buoy anchored to the seabed.

In the drawings, reference number 1 denotes a coupling unit comprising a hull 2 and a propulsion machinery 4. The coupling unit 1 is provided with a connecting element 6 according to prior art as per se for tying up to a ship 8.

DETAILED DESCRIPTION OF THE PREFERRED EMBODIMENT

During the course of this description, like numbers will be used to identify like elements according to the different views that illustrate the invention.

A hawser 10 ties the ship to a buoy 14 anchored to the seabed 12. A flexible tube connection 16 runs from the coupling unit 1 through the sea 18 and down to a pipeline 20 disposed on the seabed 12, which pipeline is connected to an onshore gas receiving installation (not shown).

During the unloading operation, the propulsion machinery 4 maintains tension in the hawser 10, whereby the ship is kept at a safe distance from the buoy 14. Thus the use of a separate tugboat for positioning purposes during the unloading operation is not required.

Figure 2:
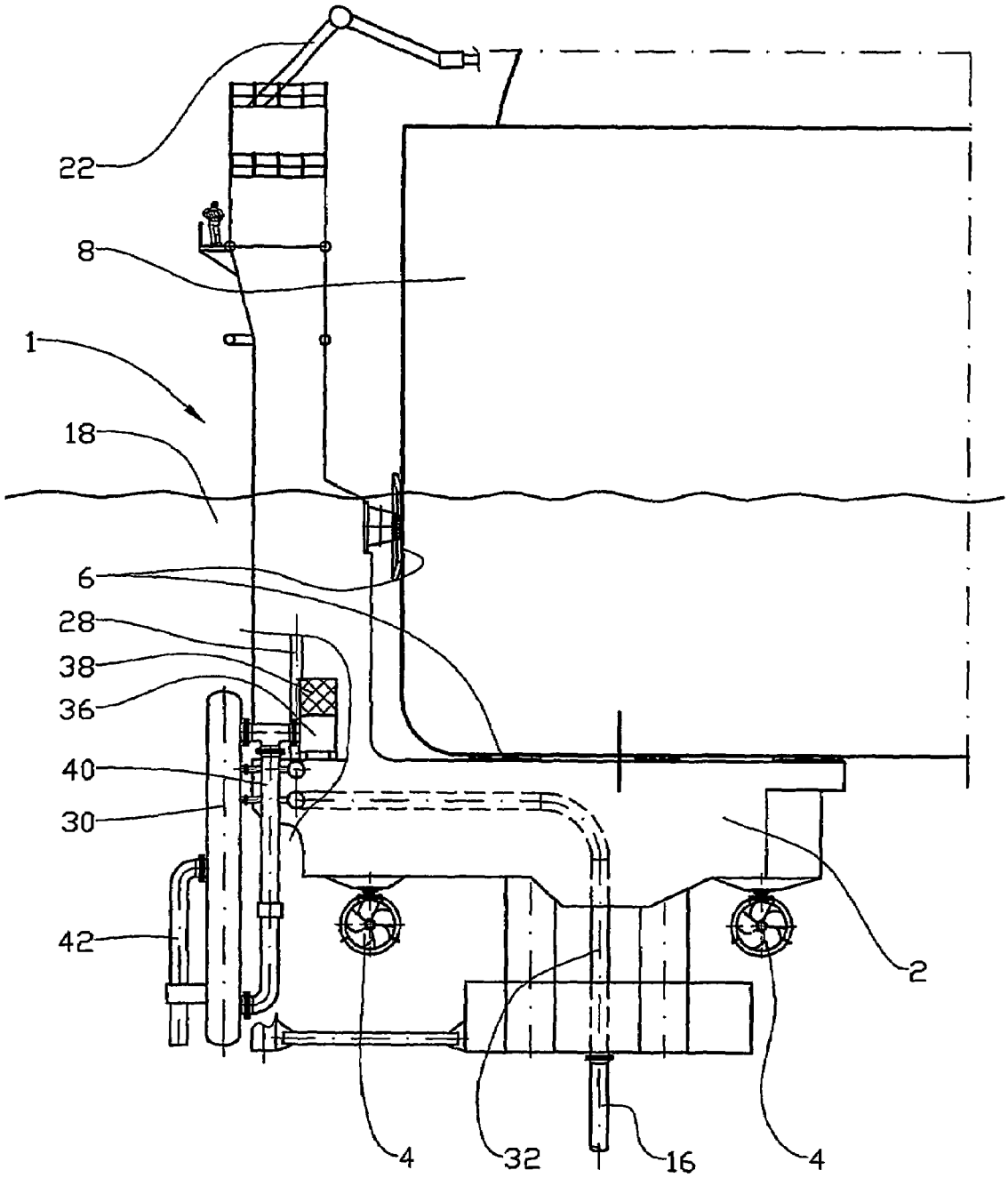
FIG. 2 is an enlarged view of the coupling unit in the operative position, seen in the longitudinal direction of the ship.
Figure 3:
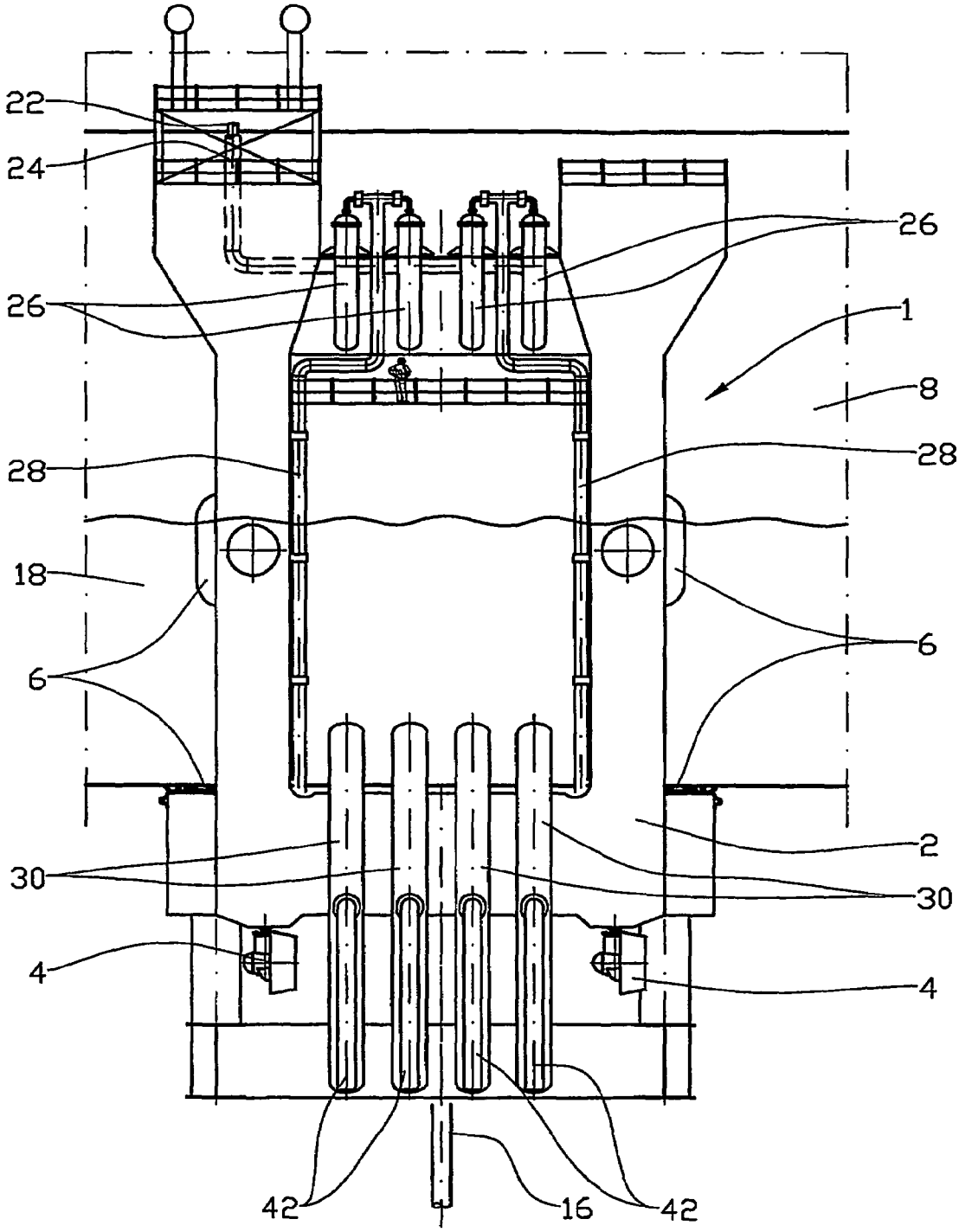
FIG. 3 is a side view of the coupling unit on the same scale.
Figure 4:
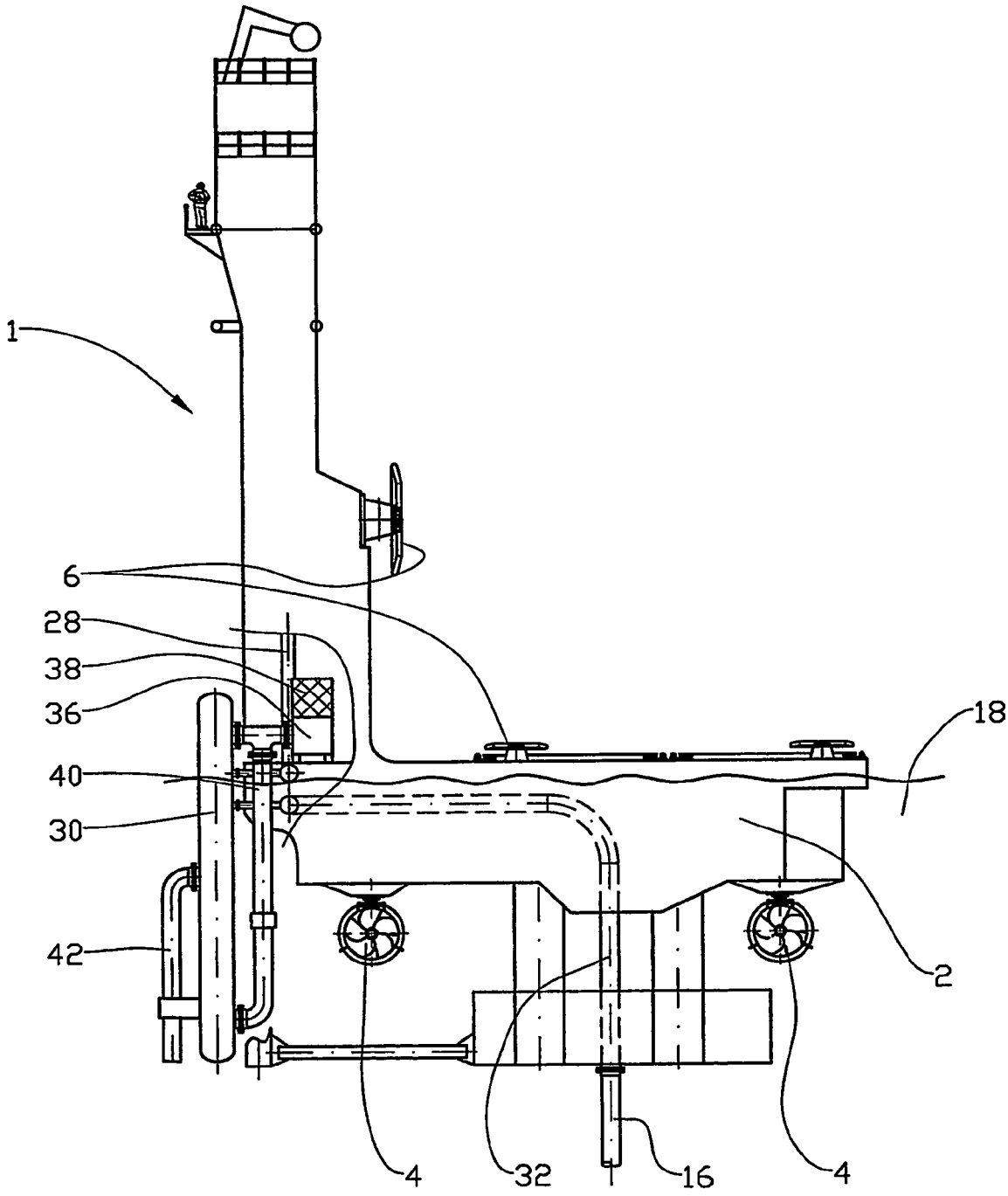
FIG. 4 shows the same view as FIG. 2, without the ship, but here the coupling unit is positioned higher up in the sea.

One end portion of a pipe connection 22, see FIG. 2, is connected to the ship's 8 loading manifold (not shown), while the opposite end portion is connected to the receiving pipe 24 of the coupling unit 1, see FIG. 3. The receiving pipe 24 conducts the incoming liquefied gas to-four gas pumps 26 arranged to increase the pressure of the incoming liquefied gas to a pressure which is appropriate for the subsequent evaporation and delivery.

From the gas pumps 26, the liquefied gas flows via high pressure gas pipes 28 to four submerged evaporators 30. In the evaporators 30, sufficient heat is added to the liquefied gas to allow it to gasify at the existing pressure.

Following the evaporation, the gas flows via a header 32, the flexible tube connection 16 and the pipeline 20 to the onshore gas receiving installation (not shown).

Seawater is pumped by seawater pumps 36 that are submerged when operative, via suction filters 38 and seawater pipes 40, through the evaporators 30 and corresponding outlet pipes 42, and back into the sea 18.

In the evaporators 40, the seawater will as a result of the temperature difference between the seawater and the liquefied gas, give off heat to the gas, causing the liquefied gas to evaporate.

In areas where the temperature of the seawater is not sufficient to provide the heat required by the gas, heating of the gas may be achieved wholly or in part by using energy from another source, e.g. from the ship's (8) steam boiler (not shown) or another source of energy (50) onboard the coupling unit (1) or onshore.

While the invention has been described with reference to the preferred embodiment thereof, it will be appreciated by those of ordinary skill in the art that modifications can be made to the parts that comprise the invention without departing from the spirit and scope thereof.

The invention claimed is:

1. A method of regasifying LNG from a ship (8) in the open sea, where use is made of a coupling unit (1) arranged to be connected to the ship (8) at the ship's (8) loading manifold, and where the coupling unit (1) is provided with a regasification plant (30) and pipelines required for transporting the regasified LNG to an onshore receiving installation, the coupling unit (1) receiving LNG from the ship via a pipe connection (22) and regasifying LNG by means of said regasification plant, then pumping the gas to the receiving site, characterized in that the coupling unit (1), which is free floating, manoeuvres itself to the ship (8) during the mooring operation to and disconnection operation from the ship (8), by means of its own propulsion machinery (4).

2. A method according to claim 1, characterized in that the coupling unit keeps the ship in the desired position during the unloading operation by means of its propulsion machinery (4).

3. A device for regasification of LNG from a ship (8) in the open sea, where use is made of a coupling unit (1) arranged to be connected to the ship (8) at the ship's (8) loading manifold, wherein the coupling device (1) is provided with a regasification plant (30) and pipelines required for transporting the regasified LNG to an onshore receiving installation, the coupling unit (1) receiving LNG from the ship via a pipe connection (22) and regasifying LNG by means of said regasification plant and pumping the gas to the receiving site, characterized in that the coupling unit (1) is free-floating and arranged to manoeuvre itself to the ship (8) during the mooring to and disconnection from the ship (8), by means of its own propulsion machinery (4).

4. A method of regasifying LNG from a ship (8) in the open sea, where use is made of a vessel (1) that receives liquefied LNG from the ship (8), where the method includes the following steps:

providing the vessel (1) with a regasification plant (30);

connecting the vessel (1) to a pipeline (20) for the purpose of transporting the regasified LNG to a receiving installation;

connecting the vessel (1) to the ship (8) by use of a pipe connection (22);

receiving LNG from the ship (8) to the vessel (1) via the pipe connection (22), characterized in that the method further includes:

providing heat for the regasifying process at least partly from an onshore source (50).

5. A method according to claim 4, characterized in that the method further includes:

manoeuvring the vessel (1) to the ship (8) during a mooring operation by means of the vessel's (1) own propulsion machinery (4).

6. A device for regasification of LNG from a ship (8) in the open sea, where use is made of a vessel (1) arranged to be connected to the ship (8) wherein the vessel (1) is provided with a regasification plant (30) and a pipeline (20) required for transporting the regasified LNG to a receiving installation, the vessel (1) receiving LNG from the ship (8) via a pipe connection (22) and regasifying LNG by means of said regasification plant (30) and pumping the gas to the receiving installation, characterized in that the vessel (1) at least partly is supplied with heat for the regasification process from an onshore source (50).

7. A device according to claim 6, characterized in that the vessel (1) is free-floating and provided with its own propulsion machinery (4), thus being designed to manoeuvre itself to the ship (8) during a mooring operation.

* * * * *